United States Patent [19]

Schmalz, Jr.

[11] Patent Number: 4,768,362

[45] Date of Patent: Sep. 6, 1988

[54] ELASTIC KEY MARKER HAVING GRAPHIC INSCRIPTION MEANS

[76] Inventor: J. William Schmalz, Jr., 720 E. Ocean Ave., Apt. 105-W, Boynton Beach, Fla. 33435

[21] Appl. No.: 75,559

[22] Filed: Jul. 20, 1987

[51] Int. Cl.[4] ..... E05B 19/04

[52] U.S. Cl. ..... 70/408; 70/456 R

[58] Field of Search ..... 70/408, 395, 457, 458, 70/456 R; 150/40; D3/61, 62

[56] References Cited

U.S. PATENT DOCUMENTS 4,305,267 12/1901 Nich ..... 70/408
4,403,487 9/1983 Marty ..... 70/408

FOREIGN PATENT DOCUMENTS 1151499 11/1963 Fed. Rep. of Germany ..... 70/408
2045852 11/1980 United Kingdom ..... 70/408

*Primary Examiner*—Robert L. Wolfe
*Attorney, Agent, or Firm*—John H. Faro

[57] ABSTRACT

Key marker comprises an elastic ring and integral flanges adapted to be stretched around the periphery of the bow of a flat key. The ring has a slot therein adapted to fit around the bit of the key. An elastic membrane integral with one of the flanges extends part way across the flange inwardly from the slot. An inscription area, which may be a coating, on the outer surface of the membrane is adapted to receive a graphic inscription thereon. There may be a similar membrane integral with the other flange. Also, there may be small protuberances distributed over the outer surfaces of the flanges.

11 Claims, 1 Drawing Sheet

ELASTIC KEY MARKER HAVING GRAPHIC INSCRIPTION MEANS

BACKGROUND OF THE INVENTION

1. Field of the Invention

This invention relates to a novel key marker and particularly to an elastic key marker having integral means for adding a graphic inscription thereon.

2. Description of the Prior Art

Whether they are carried or stored individually, in cases or on rings, it is necessary to mark keys so that it will be remembered which locks they open. A paper tag with the desired information attached to each key has been used, but the tag is easily torn and lost. A metal clip or connector with a plastic or metal sleeve thereon can be attached through the opening in each key, as described, for example, in U.S. Pat. Nos. 1,114,289 to W. R. Rittenhouse, 1,647,140 to G. B. Luby and 4,425,772 to R. A. Brewer. This latter expedient is more permanent than paper tags, but it is bulky and the clip can separate from its associated key.

There is available on the market an elastic key marker that is adapted to be stretched around the periphery of the bow of the flat key, which is the most common type of key that is used. As shown in FIGS. 1 and 2, that marker comprises an elastic ring (21) having integral elastic flanges (23) and (25) extending radially inwardly from each side of the ring (21). The ring (21) has a slot (27) adapted to fit around the bit of the the key. In use, the bit of the key is slid into the slot and then the ring (21) is stretched around the bow with the flanges on each side of the key. There are conical protuberances (29) distributed over the outer surfaces of the flanges (23) and (25). These prior markers are available in many colors so that the user can color code his keys. However, these key markers do not have any means for receiving a graphic inscription thereon. Thus, the user must remember the color code or have a separate memorandum of the color code. Also, where the key marker is in frequent use, it tends to tear across the flanges adjacent to the ends of the slot (27).

OBJECTS OF THE INVENTION

An object of this invention is to provide a novel key marker.

Another object is to provide an improved elastic key marker that is adapted to be stretched around the bow of a flat key.

A further object is to provide a novel key marker that fits on the bow of a flat key and can receive a graphic inscription thereon.

Still another object is to provide a novel key marker of the type described which is more resistant to tearing.

SUMMARY ON THE INVENTION

As in prior key markers, the novel marker comprises an elastic ring and integral radial flanges adapted to be stretched around the periphery of the bow of a flat key. The ring has a slot therein adapted to fit around the bit of the key. The improvement and novelty in the key marker of this invention includes an elastic membrane integral with one of the flanges and extending a prescribed distance across the flange inwardly from the slot, and an inscription area, which is preferably a coating, on the outer surface of the membrane that is adapted to receive a graphic marking or inscription thereon. There may be a similar membrane integral with the other flange. Also, there may be small protuberances distributed over the outer surfaces of the flanges.

A graphic inscription with specific information about the key may be written directly on the inscription area in addition to, or instead of, coding by the color of the ring and flanges. Due to the placement of the membranes, the marker is more resistant to tearing around the slot. The protuberances, which were believed to be decorative in previous markers, now hold other surfaces away from the inscription area thereby protecting the area and any inscription thereon from degradation.

DETAILED DESCRIPTION OF THE INVENTION INCLUDING THE PREFERRED EMBODIMENT

Figure 1:
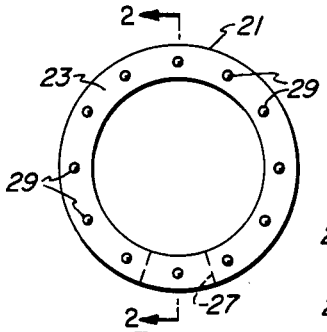
FIG. 1 (PRIOR ART)
FIGS. 1 and 2 are front and sectional side views respectively of a prior key marker.

The following description of some of the preferred embodiments of the concepts of this invention is made in reference to the accompanying figures. Where an individual structural element is depicted in more than one figure, it is assigned a common reference numeral for simplification of identification and understanding.

Figure 2:
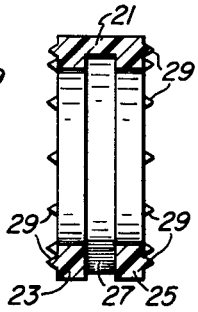
FIG. 2 (PRIOR ART)

The prior art key marker shown in FIGS. 1 and 2 comprises an elastic ring (21) having integral elastic flanges (23) and (25) extending radially inwardly from each side of the ring (21). The inner edge of each flange (23) and (25) defines a circular opening. The ring (21) has a slot (27) of such size that the bit of a key can be slid therein and then the ring (21) can be stretched over the bow of the key with a flange on each side. There are decorative conical protuberances (29) on each of the outer surfaces of the flanges (23) and (25).

Figure 3:
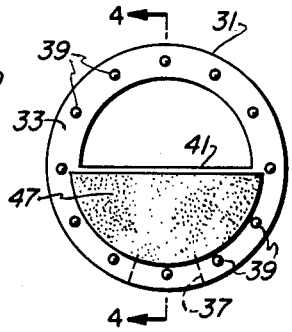
FIGS. 3 and 4 are front and sectional side views respectively of a preferred embodiment of the novel key marker.
Figure 4:
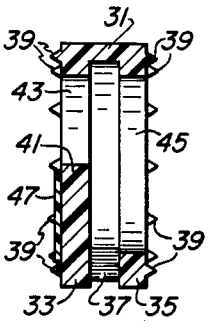

The preferred embodiment shown in FIGS. 3 and 4 is similarly construed and comprises an elastic ring (31) having integral elastic flanges (33) and (35) that extend radially inwardly from each side of the ring (31). The ring (31) has a slot (37) of such size that the bit of a key can be slid therein from inside the ring (31) and then the ring (31) can be stretched over the edge of the bow of a key with a flange (33) and (35) on each side thereof. These are also integral conical protuberances (39) distributed over the outer surfaces of the flanges (33) and (35), which flanges are functional as described below.

The novel key marker has in addition a membrane (41) integral with one flange (33). The membrane (41) extends from adjacent the slot (37) about half-way across the inner edge of the flange (33) so that the inner edge of the one flange (33) and the edge of the membrane (41) defines a semi-circular first opening (43). The inner edge of the other flange (35) defines a circular second opening (45). There is an adherent inscription coating (47) on the outer surface of the membrane (41), which coating (47) is adapted to receive thereon a graphic inscription, as with a pencil, felt-tip pen or a ball-point pen. Such adaption may be an inherently rough surface, or a roughened surface.

All of the foregoing structures including the coating (47) may be molded as a single integral unit with an elastomeric rubber or plastic material. A roughness can be cast into the surface of the inscription area instead of the inscription coating (47). In the preferred embodiment, all of the structures except the coating are injection-molded at one time with a suitable elastomeric plastic, such as SANTOPRENE, marketed by Monsanto Chemical Corporation, St. Louis, MO. The inscription coating (47) is then printed on the membrane (41) as by offset printing or by screening, with an epoxy-based ink which, when cured, has the desired surface and is strongly adherent to the molded plastic of the membrane (41).

Figure 5:
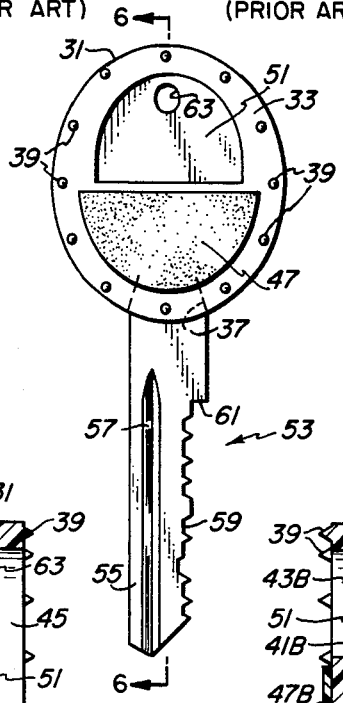
FIGS. 5 and 6 are front and sectional side views respectively of the embodiment shown in FIGS. 3 and 4 mounted on a flat key having an oval bow.
Figure 6:
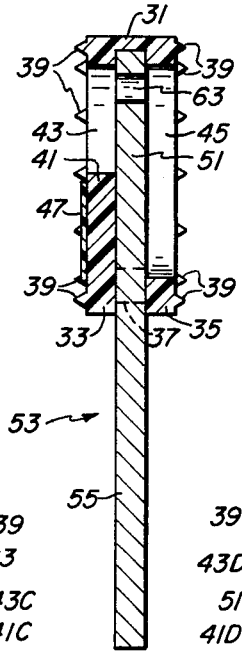

FIGS. 5 and 6 show the preferred key marker, shown in FIGS. 3 and 4, mounted on the oval bow (51) of a flat key (53). The key (53) comprises a bit (55) having a keyway (57), a cut edge (59) and a stop (61). The bow (51) has an opening or hole (63) therethrough. The bit (55) of the key (53) was slid from inside the ring (31) through the slot (37) up to the bow (51). Then, the ring (31) and flanges (33) and (35) were pulled over the edge of the bow (51) and the ring (31) was positioned on the periphery of the bow (51) with the flanges (33) and (35) on each side of the bow (51).

The combination of key and novel marker is compact and does not require any strings, wires, rings, tags or any other structure used with other markers. With this arrangement, a graphic inscription, as with a pencil or pen can be made directly on the inscription coating (47) to identify which particular lock it can open. The marker itself can be color coded to indicate which subclass of keys it is classified with; as for example, which floor of a hotel, or which employee, or which kind of automobile, it is identified with. Also, it is noteworthy that the membrane (41) provides reinforcing material around the slot (37), thereby providing resistance to tearing around the slot (37).

Figure 7:
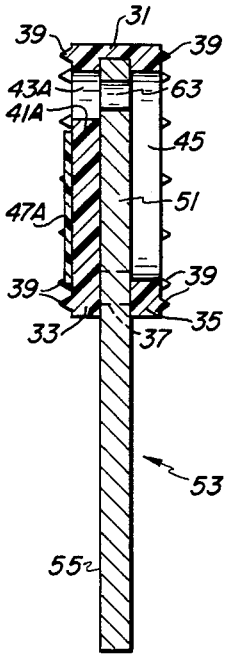
FIGS. 7, 8 and 9 are sectional side views of other embodiments of the novel marker mounted on flat keys having oval bows.
Figure 8:
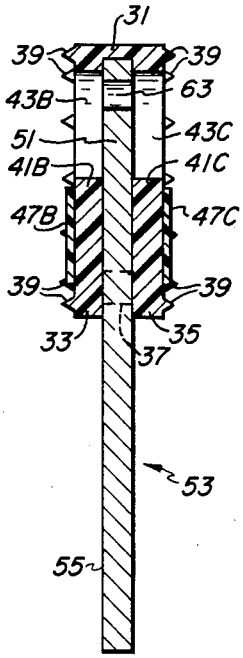
Figure 9:
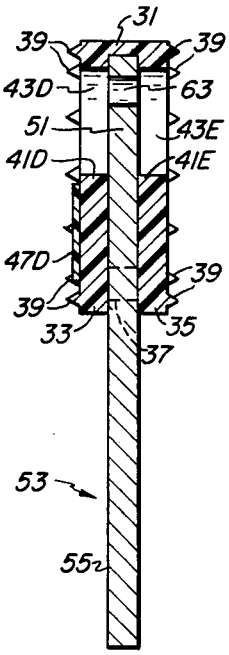

FIGS. 7, 8 and 9 show some variations in the size and placement of membranes and coatings across the flanges in alternatives of the novel key marker. In FIG. 7, both the membrane (41A) and the coating (47A) extend as far as they can across the one flange (33) without interfering with the hole (63) in the bow (51), leaving a smaller chord-shaped opening (43A). Such an arrangement is stiffer to mount on the bow (51), but provides more room for an inscription on the coating (47A) than does the embodiment of FIGS. 5 and 6.

In the embodiment shown in FIG. 8, the marker is similar to the marker shown in FIG. 6, except that it has similar half-way membranes (41B) and (41C) carrying coatings (47B) and (47C) respectively on the one flange (33) and on the other flange (35) respectively. This arrangement is also stiffer to mount on the bow (51) but it produces two coatings (47B) and (47C) for inscription. It also provides more reinforcement about the slot (37) to prevent tearing. In the embodiment shown in FIG. 9, the membrane (41D) and the coating (47D) thereon are similar to the membrane (41) and coating (47) in FIG. 6. Also, another membrane (41E) across the other flange (35) is similar to the membrane (41) in FIG. 6 but it does not carry a coating thereon. As compared with the preferred embodiment shown in FIG.6, this marker is somewhat stiffer to apply but it does provide more reinforcement against tearing around the slot (37).

All of the embodiments of the novel marker that are shown in the figures have conical protuberances (39) on the outer surfaces of the flanges (33) and (35). The protuberances (39) may be omitted if desired. The protuberances (39), if desired, can be of any size or shape and can function merely as a decoration. It is preferred however that the protuberances (39) are large enough to hold flat surfaces away from the coatings (47) to (47D) to protect them from damage and/or to prevent degradation of any graphic inscription thereon.

The foregoing figures and descriptions thereof are provided as illustrative of some of the preferred embodiments of the concepts of this invention. While these embodiments represent what is regarded as the best modes for practicing this invention, they are not intended as delineating the scope of the invention, which is set forth in the following claims.

What is claimed is:

1. In a key marker adapted to be stretched around the periphery of the bow of a flat key, said marker comprising an elastic ring and an integral elastic flange extending completely around and radially inwardly from each side of said ring, said ring having a slot therein adapted to fit around the bit of said key, the improvement comprising: a first elastic membrane integral with one of said flanges, said membrane extending from a position adjacent to said slot a prescribed distance across the flange inwardly from said slot, said one flange and said first membrane defining a first opening, and a first elastic area on the outer surface of said membrane, said first area being adapted to receive a graphic inscription thereon.

2. The marker defined in claim 1 wherein said first inscription area consists essentially of an inscription coating adhered to said first membrane.

3. The marker defined in claim 2 wherein said first membrane extends across about half the opening defined by said one flange.

4. The marker defined in claim 2 wherein said first membrane extends across substantially more than half the opening defined by said one flange.

5. The marker defined in claim 2 including a second elastic membrane integral with the other of said flanges.

6. The marker defined in claim 5 wherein both of said membranes extend across about half the opening defined by said flanges.

7. The marker defined in claim 5 wherein said first membrane extends across substantially more than half the opening defined by said one flange and said second membrane extends across about half the opening defined by said other flange.

8. The marker defined in claim 5 including a second inscription area on the outer surface of said second membrane, said second area being adapted to receive a graphic inscription thereon.

9. The marker defined in claim 8 wherein said second inscription area consists essentially of an inscription coating adhered to said second membrane.

10. The marker defined in claim 1 including a plurality of integral protuberances rising outwardly from and distributed around each of the said flanges.

11. The marker defined in claim 10 wherein said protuberances are conical.

* * * * *